US008734599B2

(12) United States Patent
Choi et al.

(10) Patent No.: US 8,734,599 B2
(45) Date of Patent: May 27, 2014

(54) STEEL WIRE ROD FOR HIGH STRENGTH AND HIGH TOUGHNESS SPRING HAVING EXCELLENT COLD WORKABILITY, METHOD FOR PRODUCING THE SAME AND METHOD FOR PRODUCING SPRING BY USING THE SAME

(75) Inventors: Sang Woo Choi, Pohang (KR); Hoe Young Jung, Pohang (KR); Yong Tae Shin, Pohang (KR); Duk Lak Lee, Pohang (KR); Jeong Do Seo, Pohang (KR); Jay Hyung Jung, Pohang (KR); Byoung Ju Park, Pohang (KR); Jae Seung Lee, Pohang (KR)

(73) Assignee: Posco (KR)

( * ) Notice: Subject to any disclaimer, the term of this patent is extended or adjusted under 35 U.S.C. 154(b) by 575 days.

(21) Appl. No.: 12/445,004

(22) PCT Filed: Oct. 10, 2007

(86) PCT No.: PCT/KR2007/004924

§ 371 (c)(1),
(2), (4) Date: Apr. 9, 2009

(87) PCT Pub. No.: WO2008/044859

PCT Pub. Date: Apr. 17, 2008

(65) Prior Publication Data

US 2010/0175795 A1 Jul. 15, 2010

(30) Foreign Application Priority Data

Oct. 11, 2006 (KR) ..... 10-2006-0098940
Oct. 9, 2007 (KR) ..... 10-2007-0101347

(51) Int. Cl.

| | |
|---|---|
| ***C22C 38/34*** | (2006.01) |
| ***C22C 38/20*** | (2006.01) |
| ***C22C 38/42*** | (2006.01) |
| ***C21D 8/06*** | (2006.01) |
| ***C21D 9/02*** | (2006.01) |

(52) U.S. Cl.
USPC ..... 148/333; 148/336; 148/908; 148/580; 148/599

(58) Field of Classification Search
USPC ..... 148/598, 599, 595, 580, 333–335, 908
See application file for complete search history.

(56) References Cited

U.S. PATENT DOCUMENTS 4,877,462 A 10/1989 Sugita
6,372,056 B1 4/2002 Kuroda et al.

(Continued)

FOREIGN PATENT DOCUMENTS

CA 2164579 A 6/1996
JP 62228431 A 10/1987

(Continued)

OTHER PUBLICATIONS

Machine-English translation of Japanese patent 2000-17388, Norito Yamao et al., Jan. 18, 2000.*

(Continued)

*Primary Examiner* — Deborah Yee
(74) *Attorney, Agent, or Firm* — The Webb Law Firm

(57) ABSTRACT

Provided is a steel wire rod for a high strength and high toughness spring having excellent cold workability, the steel wire rod having a composition comprising: in weight %, C: 0.4 to 0.7%, Si: 1.5 to 3.5%, Mn: 0.3 to 1.0%, Cr: 0.01 to 1.5%, Ni: 0.01 to 1.0%, Cu: 0.01 to 1.0%, B: 0.005 to 0.02%, Al: 0.1% or less, O: 0.0020% or less, P: 0.02% or less, S: 0.02% or less, N: 0.02% or less, remainder Fe, and other unavoidable impurities, having a microstructure formed of ferrite and pearlite, and in which a prior (before cooling) austenite grain size is 8 μm or less.

10 Claims, 3 Drawing Sheets

(56) References Cited

U.S. PATENT DOCUMENTS

| | | | | |
|---|---|---|---|---|
| 6,551,419 | B2 | 4/2003 | Kanisawa et al. | |
| 6,645,319 | B2 * | 11/2003 | Nagao et al. | 148/330 |
| 7,618,498 | B2 * | 11/2009 | Kochi et al. | 148/328 |
| 2004/0112473 | A1 * | 6/2004 | Hashimura et al. | 148/333 |
| 2006/0225819 | A1 * | 10/2006 | Yoshihara | 148/580 |

FOREIGN PATENT DOCUMENTS

| | | | |
|---|---|---|---|
| JP | 1104719 | A | 4/1989 |
| JP | 8176737 | A | 7/1996 |
| JP | 8295931 | A | 11/1996 |
| JP | 10110247 | A | 4/1998 |
| JP | 11152519 | A | 6/1999 |
| JP | 2000239797 | A | 9/2000 |
| JP | 2000256740 | A | 9/2000 |
| JP | 2000336456 | A | 12/2000 |
| KR | 19990048929 | A | 7/1999 |
| KR | 100328087 | B1 | 2/2002 |

OTHER PUBLICATIONS

Machine-English translation of Japanese patent 2002-180198, Hashimura Masayuki et al., Jun. 26, 2002.*

* cited by examiner

STEEL WIRE ROD FOR HIGH STRENGTH AND HIGH TOUGHNESS SPRING HAVING EXCELLENT COLD WORKABILITY, METHOD FOR PRODUCING THE SAME AND METHOD FOR PRODUCING SPRING BY USING THE SAME

TECHNICAL FIELD

The present invention relates to a steel wire rod for a high strength and high toughness spring having excellent cold workability, a method of manufacturing the steel wire rod, and a method of manufacturing the spring by using the steel wire rod, and more particularly, to a steel wire rod for a spring having high strength simultaneously with high toughness, the spring used as a coil spring for an automobile, a leaf spring, a torsion bar, and a stabilizer, the steel wire rod having excellent cold workability in such a way that annealing for peeling or shaving is not required in a latter process, a method of manufacturing the steel wire rod, and a method of manufacturing the spring by using the steel wire rod.

BACKGROUND ART

Recently, an amount of used fossil fuels, particularly, oil fuels is rapidly increased, seriousness of air pollution due to a pollution source generated by burning the oil fuel rises all over the world. In addition, not only there occur oil spills of large-sized oil tankers but also oil prices are rapidly increased. Accordingly, to avoid harmful influences of the oil fuel, researches on technologies to reduce the amount of used oil fuel have been performed from various angles.

There are automobiles that require the oil fuel. Manufacturers of automobiles have performed various attempts and researches to reduce the amount of used oil fuel. A method of improving fuel efficiency of automobiles, which is one of conventional methods of reducing the amount of used oil fuel, is presently developed and applied. As the method, there is a method of improving combustion efficiency and power transmission efficiency of engines. As another method, there is a method of reducing an amount of energy required in moving in a unit distance by reducing a weight of a car body.

To reduce the weight of a car body, there is a method of replacing parts of the car by lightweight material having a low specific gravity. However, till now, there are little materials replacing superiority of steel products. Accordingly, so far, there are many cases of using steel products as parts of automobile and it is general to try to improve fuel efficiency of an automobile by reducing a weight of the steel products.

When simply reducing a weight of a steel product, since a supportable load is determined for a unit weight, a fatal problem in security of automobiles may be caused. Accordingly, reducing weights of parts may be embodied after solving a problem of manufacturing parts with high strength.

Particularly, a spring for an automobile is a part strongly requiring excellent permanent deformation resistance similar to high strength. The permanent deformation resistance indicates a resistance to a permanent deformation where there is a change in height of a spring used for a long time and incapable of restoring elasticity. To increase the permanent deformation resistance of a spring, steel wire rods where a large amount of Si is added are usually used as materials for springs. Si increases yield strength of steel, thereby preventing permanent deformation.

Also, Si is an element belonging to IV group in a periodic table and acting similarly to C in an aspect of thermodynamics. As described above, it is also required to improve strength, that is, tensile strength of springs. To improve the strength, an element essentially added is C. It is easy to add C. C improves strength of steel by improving precipitation strength together with other added alloy elements. However, when adding C simultaneously with a large amount of Si in an alloy, due to similar thermodynamic actions of C and Si, C and Si compete for a place, thereby generating a decarburization phenomenon where C is removed from the alloy.

As steel for spring with Si, there is SAE9250. Since a content of Si in the steel for spring is 1.8 to 2.0 wt %, a surface decarburization phenomenon of C from the steel becomes more serious. As a result, a fatigue life of the steel is decreased due to a surface-carburized layer in such a way that it is difficult to use the steel for a spring.

To solve such problems, Japanese Patent Application Nos. 1998-110247 and 1996-176737, Korean Patent Application No. 1997-0073576, and Korean Patent Laid-Open Publication No. 1999-0048929 disclose high tensile spring steel in which an overall amount of carbon is reduced and Ni is added to prevent an existence of a decarbonized portion on a surface, an amount of Si is more increased to restore a decrease in strength due to the decrease of the carbon amount, and Mo is additionally added in such a way that maximum designed toughness is increased to 1200 MPa.

However, in the case of the conventional steel, since the amount of Si is increased to improve yield strength and a deformation resistance in an aspect of alloy design, Si segregation occurs when continuously casting. Since the Si segregation is generally formed in a center of a steel wire rod, the occurrence of the segregation causes generation of ferrite in such a way that an nonuniformity of a central microstructure is caused, thereby generating a wide range of a change in properties and deteriorating toughness of a spring.

Also, since the conventional high stress steel contains a large amount of an alloy element, manufacturing costs are increased. In addition, due to the large amount of the added alloy element, though a steel wire rod is slowly cooled down at a relatively low speed when manufacturing the steel wire rod, there is generated a low temperature structure such as a composite structure of bainite and martensite. When the low temperature structure occurs while manufacturing a steel wire rod, a problem may be caused in processing in a latter process. That is, the low temperature structure such as bainite or martensite has high hardness due to internal toughness generated in transformation. The low temperature structure make it difficult peeling or shaving the steel wire rod to control diameter of the steel wire rod or modify surface quality before forming a spring using the steel wire rod. Accordingly, to smoothly peel or shave, a heat treatment such as a softening heat treatment is performed on the steel wire rod, which causes additional increase of manufacturing costs and deterioration of workability.

In addition, generally, since strength and toughness are opposite concepts to each other, it is difficult to provide strength and toughness at the same time. That is, generally, to improve strength of a spring, it is essential to form a rigid structure such as martensite or bainite in a steel wire rod. However, since being brittle, the rigid structure such as martensite or bainite has poor impact toughness.

As described above, a spring requires high strength to provide high permanent deformation resistance and fatigue strength and high toughness in addition to the high strength. Up to now, steel for a spring, which has both of high strength and high toughness, has not yet been developed. Also, since a low temperature structure occurs in a portion of the steel for a spring, spring custom company has to perform a softening heat treatment.

An aspect of the present invention provides a steel wire rod for a high strength and high toughness spring, which has excellent cold workability in a latter process, and a method of manufacturing the steel wire rod.

An aspect of the present invention also provides a method of manufacturing a high strength and high toughness spring by using the steel wire rod.

SUMMARY OF THE INVENTION

According to an aspect of the present invention, there is provided a steel wire rod having a composition including: in weight %, C: 0.4 to 0.7%, Si: 1.5 to 3.5%, Mn: 0.3 to 1.0%, Cr: 0.01 to 1.5%, Ni: 0.01 to 1.0%, Cu: 0.01 to 1.0%, B: 0.005 to 0.02%, Al: 0.1% or less, O: 0.0020% or less, P: 0.02% or less, S: 0.02% or less, N: 0.02% or less, remainder Fe, and other unavoidable impurities, having an internal structure (microstructure) formed of ferrite and pearlite, the internal structure in which prior austenite grain size is 8 μm or less.

In this case, a sum of areal fractions of bainite and martensite structures among the internal structure of the steel wire rod may be less than 1%.

The composition of the steel wire rod may further include, in weight %, V: 0.5% or less and Ti: 0.5% or less.

According to another aspect of the present invention, there is provided a method of manufacturing a steel wire rod for a high strength and high toughness spring having excellent cold workability, wherein, when hot rolling a billet having a composition including: in weight %, C: 0.4 to 0.7%, Si: 1.5 to 3.5%, Mn: 0.3 to 1.0%, Cr: 0.01 to 1.5%, Ni: 0.01 to 1.0%, Cu: 0.01 to 1.0%, B: 0.005 to 0.02%, Al: 0.1% or less, O: 0.0020% or less, P: 0.02% or less, S: 0.02% or less, N: 0.02% or less, remainder Fe, and other unavoidable impurities, to manufacture the steel wire rod, rolling temperatures at a second rolling mill and latter rolling mills from a final rolling mill are 850° C. or less.

The composition of the steel wire rod may further include, in weight %, V: 0.5% or less and Ti: 0.5% or less.

The rolling temperatures may be Ar3 or more.

The rolled steel wire rod may be started being cooled down at a temperature of 700 to 850° C. at a speed of cooling 5° C./second to a room temperature.

According to still another aspect of the present invention, there is provided a method of manufacturing a steel wire rod for a high strength and high toughness spring having excellent cold workability, the steel wire rod having a composition including: in weight %, C: 0.4 to 0.7%, Si: 1.5 to 3.5%, Mn: 0.3 to 1.0%, Cr: 0.01 to 1.5%, Ni: 0.01 to 1.0%, Cu: 0.01 to 1.0%, B: 0.005 to 0.02%, Al: 0.1% or less, O: 0.0020% or less, P: 0.02% or less, S: 0.02% or less, N: 0.02% or less, remainder Fe, and other unavoidable impurities, having an internal structure formed of ferrite and pearlite, the internal structure in which prior austenite grain size is 8 μm or less, the method including: peeling and shaving the steel wire rod without annealing; austeniting the steel wire rod; oil-cooling the austenited steel wire rod; tempering the oil-cooled steel wire rod; and cold working the tempered steel wire rod in a spring shape.

According to yet another aspect of the present invention, there is provided a method of manufacturing a steel wire rod for a high strength and high toughness spring having excellent cold workability, the steel wire rod having a composition including: in weight %, C: 0.4 to 0.7%, Si: 1.5 to 3.5%, Mn: 0.3 to 1.0%, Cr: 0.01 to 1.5%, Ni: 0.01 to 1.0%, Cu: 0.01 to 1.0%, B: 0.005 to 0.02%, Al: 0.1% or less, O: 0.0020% or less, P: 0.02% or less, S: 0.02% or less, N: 0.02% or less, remainder Fe, and other unavoidable impurities, having an internal structure formed of ferrite and pearlite, the internal structure in which prior austenite grain size is 8 μm or less, the method including: peeling and shaving the steel wire rod without annealing; hot working the steel wire rod in a spring shape; austeniting the hot worked spring; oil-cooling the austenited spring; and tempering the oil cooled spring.

In this case, an austeniting temperature may be 900 to 1000° C.

Also, a tempering temperature may be 350 to 450° C.

According to an exemplary embodiment of the present invention, not only a high strength, high toughness spring may be provided but also peeling and shaving works may be performed without particular heat processing due to excellent cold workability of a steel wire rod manufactured to provide the spring.

BEST MODE FOR CARRYING OUT THE INVENTION

Figure 1:
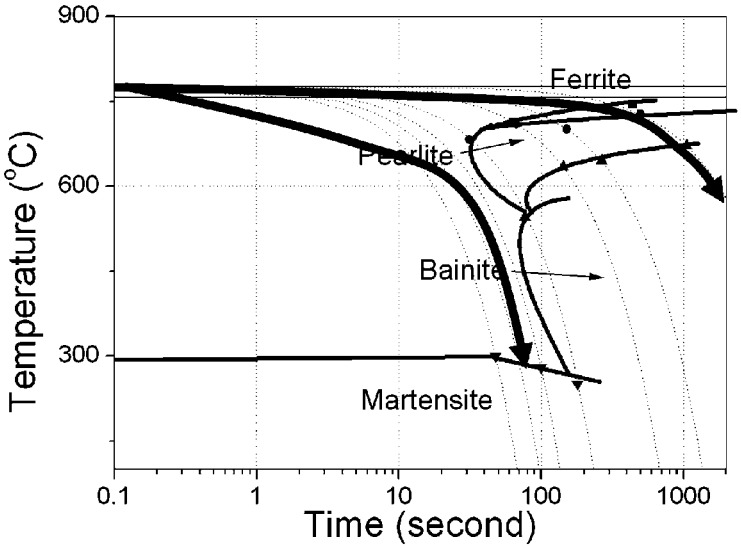
FIG. 1 is a CCT diagram illustrating a general steel wire rod being cooled.

Hereinafter, embodiments of the present invention will be described in detail.

Generally, tensile strength and impact toughness have properties opposite to each other. Accordingly, it is important to reduce a decrease in a value of tensile strength while increasing a value of impact toughness. Accordingly, a composition of steel for a spring, described below, may increase impact toughness while keeping tensile strength high.

To embody such technical ideas, the present inventors controls a composition of a steel wire rod as follows, thereby providing strength and improving toughness by forming oxygen/carbon/nitrogen-based precipitates of Al, B, V, and Ti in the steel wire rod when manufacturing a spring using the steel wire rod having the following composition, simultaneously with strengthening quenching properties when heat treating by using B improving the quenching properties, and strengthening grain boundaries.

Hereinafter, constituents of a steel wire rod will be described.

C: 0.4 to 0.7 wt %

C is an essential element that is added to provide strength of a spring. When a content of C is less than 0.4 wt %, since quenching properties are not provided, strength required in steel for a spring is not provided. Also, when the content of C is more than 0.7 wt %, twin martensite structures are formed and cracks are generated in a material when quenching and tempering, thereby notably decreasing fatigue strength. In addition, since it is difficult to provide toughness enough to high strength and control decarbonization of the material, generated by adding a large amount of Si, the content of C may be limited to be in a range from 0.4 to 0.7 wt %.

Si: 1.5 to 3.5 wt %

Si is employed in ferrite and improves strength of a basic material and a deformation resistance. However, when a content of Si is less than 1.5 wt %, the effect is not enough. A lower limit of the content of Si may be 1.5 wt %. When the content of Si is more than 3.5 wt %, the effect of improving a deformation resistance is no more increased and there is no additional effect. Also, surface decarbonization is caused in a heat treatment. Accordingly, the content of Si may be limited to be in a range from 1.5 to 3.5 wt %.

Mn: 0.3 to 1.0 wt %

When Mn is present in steel, quenching properties of the steel is improved to provide strength. When a content of Mn is less than 0.3 wt %, it is difficult to obtain strength and quenching properties required in a material for a high strength spring. When the content of Mn is more than 1.0 wt %, toughness is decreased. Accordingly, the content of Mn may be limited to be in a range from 0.3 to 1.0 wt %.

Cr: 0.01 to 1.5 wt %

Cr is useful to provide an oxidation resistance and temper softening, prevent surface decarbonization, and provide quenching properties. However, when a content of Cr is less than 0.01 wt %, it is difficult to provide the oxidation resistance, the temper softening, the surface decarbonization prevention, and the quenching properties. When the content of Cr is more than 1.5 wt %, a decrease in a deformation resistance is caused to decrease strength. Accordingly, the content of Cr may be limited to be in a range from 0.01 to 1.5 wt %.

Ni: 0.01 to 1.0 wt %

Ni is an element added to improve quenching properties and toughness. When a content of Ni is less than 0.01 wt %, an effect of improving the quenching properties and toughness is not enough. When the content of Ni is more than 1.0 wt %, since an amount of residual austenite is increased, a fatigue life is reduced. Also, due to high prices of Ni, a rapid increase of manufacturing costs is caused. Accordingly, the content of Ni may be limited to be in a range from 0.01 to 1.0 wt %.

Cu: 0.01 to 1.0 wt %

Adding Cu is useful to prevent surface decarbonization and improve a corrosion resistance. A decarbonized layer notably decreases a fatigue life of a spring after processing. An effect of preventing surface decarbonization and improving a corrosion resistance is insignificant when a content of Cu is less than 0.01 wt %. Also, the content of Cu is more than 1.0 wt %, a defect in rolling, due to embrittlement, is caused.

B: 0.005 to 0.02 wt %

Adding B has an effect of densifying rust formed on a surface, increasing a corrosion resistance, and increasing strength of grain boundaries by improving hardenability. When a content of B is less than 0.005 wt %, since quenching properties are not provided, strength required in steel for a spring is incapable of being provided. When the content of B is more than 0.02 wt %, carbonitride-based precipitates become coarse to have a bad influence upon fatigue properties.

O: 0.0020 wt % or less

When a content of O is more than 0.0020 wt %, coarse oxide-based nonmetallic inclusions are formed, thereby rapidly decreasing a fatigue life. Therefore O is preferably contained 0.0020 wt % or less in the steel.

Al: 0.1 wt % or less

Adding Al makes grain sizes refined and improves toughness. When a content of Al is more than 0.1 wt %, an amount of generated oxide-based precipitates is increased simultaneously with being coarse, thereby having a bad influence upon fatigue properties.

P and S: 0.02 wt % or less, respectively

Contents of P and S are limited to be 0.02 wt % or less. Since P segregates from grain boundaries and decreases toughness, an upper limit of the content of P may be limited to 0.02 wt %. Since S has a low melting point, segregates from grain boundaries, decreases toughness, forms emulsion, and has a bad influence upon properties of a spring.

N: 0.02 wt % or less

N is easy to form BN by acting with B and decreases quenching properties. Accordingly, it is good to decrease a content of N as possible. However, considering process load, the content of N may be limited to be 0.02 wt % or less.

There is obtained a satisfactory effect by using only the described composition. However, strength and toughness of steel are capable of being improved by adding V and Ti to the advantageous composition of the steel as follows.

V: 0.005 to 0.5 wt % or less, and Ti: 0.005 to 0.5 wt % or less

V and Ti are elements more helpful to the composition of the steel for a spring, which form carbide or nitride by solitarily or compositely adding and causes precipitation hardening, thereby improving spring properties. Contents of V and Ti are limited to be in ranges from 0.005 to 0.5 wt % and from 0.005 to 0.5 wt %, respectively. When the content is lower, since precipitation of V and Ti-based carbide and nitride is decreased, effects of controlling grain boundaries and improving spring properties such as fatigue properties and permanent deformation resistance are not enough. When the content is higher, manufacturing costs are rapidly increased and there is no additional effect of improving spring properties by using the precipitates. Also, an amount of coarse alloy carbide not solved in a basic material when heat treating austenite is increased and acts as nonmetallic inclusion, thereby decreasing fatigue properties and an effect of strengthening precipitation.

When manufacturing a spring by using a steel wire rod having the composition, as described above, the spring having excellent strength and toughness may be obtained.

However, as described above, when controlling a composition to improve strength of a spring, a low temperature structure is easily formed when cooling a steel wire rod in such a way that hardness of the steel wire rod is also increased. Accordingly, since cold workability is deteriorated, though using the steel wire rod having the described composition, it is not possible to provide excellent cold workability by using a general manufacturing method.

As a result of researching causes of the described problems, by using a general composition of steel for a spring, though relative slow cooling is performed, a cooling curve on the CCT diagram shown in FIG. 1 is not capable of passing through a ferrite or pearlite area and directly enters a bainite or martensite area. Accordingly, it may be known that there is generated a large amount of low temperature structures such as bainite or martensite.

Accordingly, it may be considered to pass through the pearlite or ferrite area by slowing a cooling speed not to generate the low temperature structure. However, it is a result of an investigation of the present inventors that the cooling speed should be less than 3° C./second in such a way that the cooling curve in a general composition of steel for a spring, including the composition according to the present invention, passes through the ferrite or pearlite area on the CCT diagram. However, a cooling ability of an apparatus for cooling steel wire rods, which is generally employed in the present, is 5° C./second or less. It is very difficult to accurately control the cooling speed to be less than 3° C./second. Accordingly, it is undesirable to manufacture a steel wire rod with excellent cold workability by slowing a cooling speed.

Figure 2:
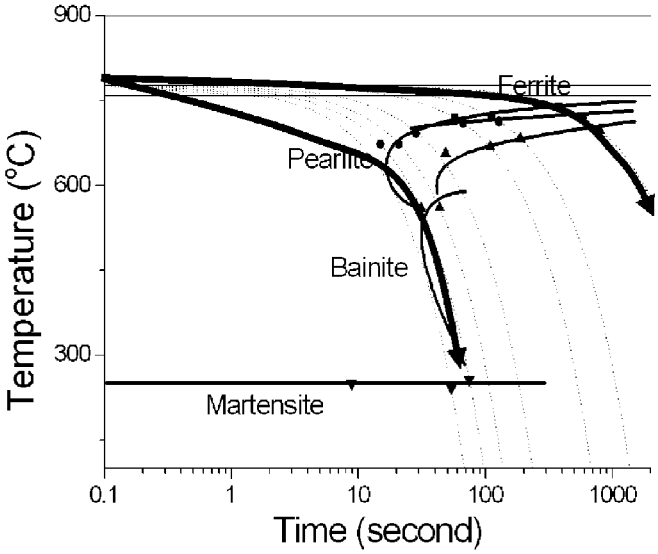
FIG. 2 is a CCT diagram illustrating a steel wire rod having fine grains, being cooled after being rolled.

As another method, there is a method where a pearlite nose shown in FIG. 1 is moved to left in such a way that the cooling curve is capable of passing through the pearlite or ferrite area enough at a relatively high cooling temperature, that is, there is a small amount of time is used (a horizontal axis of the CCT diagram is time). A CCT diagram in this case may be as shown in FIG. 2.

Generally, a form of a CCT diagram depends on a composition. However, as a result of research of the present inventors, it is capable of being checked that the form of the CCT diagram is capable of being controlled by controlling grain sizes though a composition of a steel wire rod is fixed.

That is, in a general process of manufacturing steel wire rods, grain sizes of austenite of an internal structure of the steel wire rod before cooling is about 12 μm. The form of the CCT diagram in this case becomes as shown in FIG. 1. However, as an important condition of the present invention, when the grain sizes of austenite before cooling is controlled to be 8 μm or less, the CCT diagram has the form where the pearlite and ferrite area are considerably moved to left, that is, to a direction of a short time, as shown in FIG. 2. Grains of ferrite or pearlite are transformed in grain boundaries. When an austenite grain size (AGS) before transformation is fine, grain boundary interfaces required in the transformation of the ferrite or pearlite are rapidly increased in such a way that an amount of transformed ferrite or pearlite is increased.

Accordingly, to manufacture a steel wire rod having excellent cold workability due to hardness not high at a relatively high cooling temperature without change in composition, it is important to control a AGS before cooling to be 8 μm or less. Accordingly, the steel wire rod according to the present invention has the advantageous composition where an internal structure is formed of ferrite and pearlite and prior (before cooling) austenite grain size in the internal structure is 8 μm or less.

Also, it is good that low temperature structures such as bainite and martensite are not formed as possible. Since the low temperature structure may be unavoidably formed to a certain degree, an amount thereof may be less than 1% as a fraction to an area of an entire structure.

There may be various methods for controlling AGS. That is, the AGS greatly depends on an amount and speed of transformation in hot rolling and a temperature of the hot rolling. By the hot rolling conditions, static recrystallization, dynamic recrystallization, semidynamic recrystallization, and grain growth occur. When a cross-section of a processed material such as hot rolled a steel wire rod is a circular shape and a rolling speed is high, it is difficult to change an amount and speed of transformation. Accordingly, recrystallization behavior and grain growth behavior may be controlled by controlling a hot rolling temperature.

To fine grains by controlling a hot rolling temperature, there is generally used a method where rolling is performed while keeping a temperature of an overall finishing rolling section to be low in such a way that recrystallization is suppressed and a form of austenitic grains is made to be a pancake and fined. However, in this case, since a load on a rolling mill is added in an overall finishing rolling process, a load on equipment occurs, thereby having a bad influence upon power consumption and equipment life.

Figure 3:
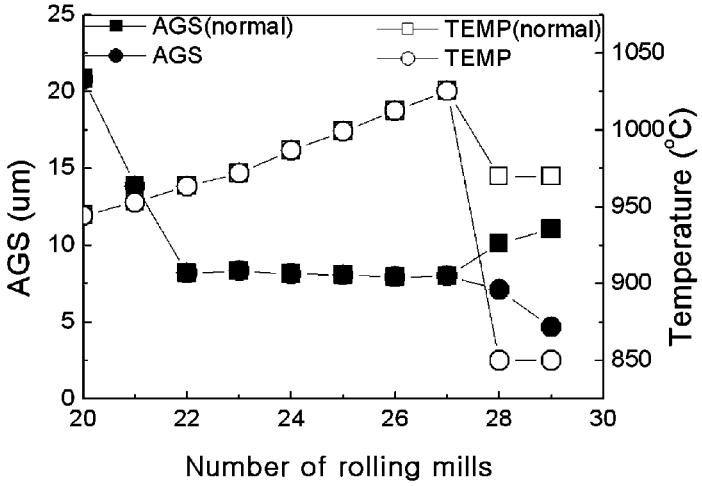
FIG. 3 is a graph illustrating a grain size when decreasing a rolling temperature at a second rolling mill and latter rolling mills from a final rolling mill and a grain size of a case contrary thereto.

However, according to the present inventors, as shown in FIG. 3, though rolling is performed in an overall rolling section, rolling sections, which contain a second rolling mill and a latter rolling mill from a final rolling mill, actually have an influence upon AGS. When a rolling temperature of the rolling mill is kept to be from 750 to 850° C., the AGS may be controlled to be 8 μm or less. In FIG. 3, a mark having a square shape indicates a case of manufacturing a steel wire rod in a normal manufacturing pattern, in which □ indicates temperature behavior and ■ indicates a change in the AGS. Similarly, a mark having a circular shape indicates a case of manufacturing a steel wire rod in a manufacturing pattern according to the present invention, in which ○ indicates temperature behavior and ● indicates a change in the AGS. As shown in FIG. 3, in the case of the manufacturing pattern according to the present invention, when keeping a rolling temperature to be 850° C. at the second rolling mill and latter rolling mill from the final rolling mill, AGS is finally less than 5 μm. In the case of the normal manufacturing pattern, a rolling temperature at a second rolling mill and latter rolling mills from a final rolling mill is 950° C. or more and grain sizes in a manufactured steel wire rod are shown as 12 μm or more. Since semidynamic recrystallization occurs in a first half portion of rolling, grain sizes of the steel wire rod are not greatly changed. On the other hand, in a second half portion of the rolling, particularly, at the second rolling mill and latter rolling mill from the final rolling mill, since static recrystallization of the steel wire rod occurs, recrystallization behavior is slaved and grain growth is delayed, thereby obtaining an effect of fining grains by rolling.

Therefore, it is important to keep the rolling temperature at the second rolling mill and latter rolling mill from the final rolling mill, to be 850° C. or less.

However, when a finishing rolling temperature is Ar3 or less, transformation of austenite/ferrite occurs before fining austenite by rolling, thereby forming coarse ferrite. Accordingly, the finishing rolling temperature may be more than Ar3.

The Ar3 depends on a composition of a steel wire rod. The Ar3 with respect to the steel wire rod according to the present invention is determined to be about 740° C.

In the process of manufacturing the steel wire rod, others in addition to controlling the temperature at the second rolling mill and latter rolling mill from the final rolling mill are similar to those of a general process of manufacturing a steel wire rod. That is, those skilled in the art may easily manufacture a steel wire rod for a spring by reheating, starting rolling, finishing rolling, and cooling a billet by using various well-known art, in which it is required to control a temperature at two or more final rolling mills.

The cooling may start at a temperature from 700 to 850° C. and finish at a room temperature at a speed of 5° C./second or less.

After that, the steel wire rod manufactured by the described process may be peeled, shaved, processed to be austenitic, tempered after being oil-cooled, and cold processed to be in a spring shape or hot processed in a spring shape without softening heat treatment in a latter process. On the other hand, the steel wire rod may be hot processed to be in a spring shape at a temperature from 850 to 1000° C., processed to be austenitic, oil-cooled, and tempered to be manufactured into a spring.

An approximate temperature range of the spring manufacturing method is identical to a general spring manufacturing condition. Only, it is the feature of the spring manufacturing method according to the present invention that softening heat treatment is not performed.

Accordingly, a peeling condition, a shaving condition, an austeniting temperature, an oil-cooling temperature, and a quenching temperature are based on general spring manufacturing conditions.

However, the austeniting be performed at a temperature from 900 to 1000° C. to prevent coarse grains generated by recrystallization. That is, when the temperature of the austeniting is less than 900° C., proeutectoid ferrite is generated in the cooling due to the low temperature. When the temperature is more than 1000° C., decarbonization and grain growth are caused. After the austeniting, quenching is finished by rapid cooling.

A quenched spring has high strength. However, since martensite structure is not helpful to improve toughness, tempering may follow. The internal structure is changed from martensite to tempered martensite by the tempering.

A tempering temperature may be from 350 to 450° C. When the tempering temperature is less than 350° C., an effect of tempering the martensite is not enough, thereby deteriorating toughness of a spring. When the tempering temperature is more than 450° C., the martensite may be transformed into a higher temperature structure. Accordingly, the tempering temperature may be from 350 to 450° C.

Hereinafter, inventive examples of the present invention will be described in detail. It will be understood that the present invention is not limited to the described inventive examples. Instead, it would be appreciated by those skilled in the art that changes may be made to these examples without departing from the principles and spirit of the invention, the scope of which is defined by the claims and their equivalents.

EXAMPLES

Steel wire rods were manufactured by casting steel having compositions as shown in following Table 1 to manufacture billets and hot rolling the billet under conditions shown in Table 2. The hot rolled steel wire rods were processed in a spring shape, heat treated at 950° C., oil-cooled, and heat treated at a tempering temperature of 390 and 420° C. as shown in Table 3, thereby manufacturing specimens.

When processing in a spring shape, referring to Table 2, since having excellent cold workability, inventive examples 1 to 6 were peeled, shaved, and processed to be in the spring shape, without additional softening heat treatment. However, since comparative examples lacked cold workability, when directly peeling and shaving, it was worried that materials were damaged. Accordingly, the comparative examples were softening heat treated at a temperature from 500 to 700° C. for 120 to 180 minutes, peeled, shaved, and processed to be springs.

To check cold workability of steel wire rods manufactured under the conditions as shown in Table 2, tension test was performed. Samples for the tension test were obtained by extracting in a rolling direction and processing into an ASTM-Sub size. The tension test was performed at cross head speed of 2 mm/min. Detailed values were shown in Table 2.

TABLE 1

| | C | Si | Mn | Ni | Cr | V | Ti | Cu | B | P | S | Al | N | O |
|---|---|---|---|---|---|---|---|---|---|---|---|---|---|---|
| comparative example 1 | 0.55 | 3.0 | 0.5 | 0.25 | 0.7 | 0.05 | — | 0.1 | 0.001 | 0.01 | 0.03 | 0.001 | 50 | 16 |
| comparative example 2 | 0.55 | 2.2 | 0.5 | 0.25 | 0.7 | 0.20 | — | 0.1 | — | 0.008 | 0.008 | 0.01 | 49 | 16 |
| comparative example 3 | 0.50 | 2.2 | 0.7 | 0.30 | 1.0 | 0.20 | 0.07 | 0.3 | 0.03 | 0.009 | 0.007 | 0.06 | 55 | 14 |
| comparative example 4 | 0.6 | 1.4 | 0.6 | — | 0.5 | — | — | — | — | 0.03 | 0.01 | 0.07 | 48 | 19 |
| Inventive example 1 | 0.45 | 2.9 | 0.7 | 0.5 | 1.2 | 0.4 | 0.3 | 0.3 | 0.006 | 0.008 | 0.009 | 0.03 | 49 | 15 |
| Inventive example 2 | 0.49 | 3.1 | 0.6 | 0.3 | 0.4 | 0.2 | 0.4 | 0.5 | 0.001 | 0.012 | 0.008 | 0.02 | 59 | 13 |
| Inventive example 3 | 0.55 | 2.6 | 0.7 | 0.1 | 0.6 | 0.4 | 0.2 | 0.8 | 0.008 | 0.009 | 0.015 | 0.05 | 53 | 11 |
| Inventive example 4 | 0.59 | 2.6 | 0.4 | 0.7 | 1.2 | 0.2 | 0.4 | 0.5 | 0.014 | 0.015 | 0.009 | 0.06 | 52 | 13 |
| Inventive example 5 | 0.64 | 1.9 | 0.8 | 0.5 | 1.3 | 0.3 | 0.4 | 0.1 | 0.017 | 0.018 | 0.015 | 0.04 | 48 | 10 |
| Inventive example 6 | 0.69 | 1.6 | 0.9 | 0.8 | 0.9 | 0.2 | 0.09 | 0.4 | 0.007 | 0.005 | 0.016 | 0.07 | 49 | 12 |

Wherein contents of respective elements are shown in wt %, except for N and O, which are shown in ppm.

TABLE 2

| | | | Cooling speed (3° C./sec) | | Cooling speed (5° C./sec) | | Cooling speed (7° C./sec) | |
|---|---|---|---|---|---|---|---|---|
| | Fourth rolling mill from final rolling mill (° C.) | Prior austenite grain size (μm) | Low temperature structure fraction (%) | Strength of steel wire rod (MPa) | Low temperature structure fraction (%) | Strength of steel wire rod (MPa) | Low temperature structure fraction (%) | Strength of steel wire rod (MPa) |
| Comparative example 1 | 960 | 12 | 2 | 1100 | 3 | 1140 | 10 | 1200 |
| Comparative example 2 | 980 | 14 | 3 | 1098 | 4 | 1120 | 13 | 1198 |
| Comparative example 3 | 970 | 13 | 2.2 | 1060 | 4 | 1100 | 12 | 1150 |
| Comparative example 4 | 975 | 15 | 3.3 | 1110 | 5 | 1143 | 14 | 1200 |
| Inventive example 1 | 850 | 6 | 0.5 | 980 | 0.5 | 983 | 1.1 | 1030 |

TABLE 2-continued

| | Fourth rolling mill from final rolling mill (° C.) | Prior austenite grain size (μm) | Cooling speed (3° C./sec) Low temperature structure fraction (%) | Cooling speed (3° C./sec) Strength of steel wire rod (MPa) | Cooling speed (5° C./sec) Low temperature structure fraction (%) | Cooling speed (5° C./sec) Strength of steel wire rod (MPa) | Cooling speed (7° C./sec) Low temperature structure fraction (%) | Cooling speed (7° C./sec) Strength of steel wire rod (MPa) |
|---|---|---|---|---|---|---|---|---|
| Inventive example 2 | 830 | 4 | 0.2 | 950 | 0.3 | 965 | 0.9 | 1000 |
| Inventive example 3 | 790 | 5 | 0.9 | 990 | 0.9 | 995 | 1.3 | 1040 |
| Inventive example 4 | 800 | 6 | 0.8 | 984 | 0.8 | 993 | 1.5 | 1060 |
| Inventive example 5 | 830 | 5 | 0.7 | 960 | 0.7 | 964 | 1.0 | 1020 |
| Inventive example 6 | 780 | 5 | 0.6 | 950 | 0.7 | 958 | 0.9 | 1040 |

Wherein low temperature structure fraction indicates area fraction and strength of steel wire rods indicates tensile strength. Also, temperatures of the fourth rolling mill from the final rolling mill to the final rolling mill are actually kept to be identical.

TABLE 3

| | Tempering temperature: 390° C. Tensile strength (MPa) | Tempering temperature: 390° C. Elongation (%) | Tempering temperature: 390° C. Impact value (J) | Tempering temperature: 420° C. Tensile strength (MPa) | Tempering temperature: 420° C. Elongation (%) | Tempering temperature: 420° C. Impact value (J) |
|---|---|---|---|---|---|---|
| Comparative example 1 | 1987 | 6 | 3.2 | 1890 | 7 | 3.7 |
| Comparative example 2 | 1923 | 6 | 4.1 | 1884 | 6 | 4.7 |
| Comparative example 3 | 1930 | 5 | 3.7 | 1872 | 6 | 4.5 |
| Comparative example 4 | 2001 | 6 | 2.8 | 1930 | 7 | 3.5 |
| Inventive example 1 | 2097 | 15 | 6.5 | 2035 | 16 | 7.4 |
| Inventive example 2 | 2100 | 13 | 5.9 | 2060 | 15 | 6.6 |
| Inventive example 3 | 2198 | 10 | 6.1 | 2120 | 12 | 6.9 |
| Inventive example 4 | 2200 | 9 | 5.4 | 2145 | 10 | 6.3 |
| Inventive example 5 | 2235 | 9 | 5.6 | 2197 | 10 | 6.2 |
| Inventive example 6 | 2309 | 8 | 5.3 | 2265 | 10 | 6.0 |

As known from Table 2, when cooling speed was 3° C./second and 5° C./second, in comparative examples 1 to 4, in which constituents and a rolling temperature of rolling mills were out of ranges defined according to the present invention, low temperature structure fractions were shown as very high more than 2%. As a result thereof, strength of steel wire rods was shown much higher than that of inventive examples 1 to 6. On the other hand, in the case of inventive examples 1 to 6, fractions of the low temperature structure were less than 1%, which belong to a range suitable for cold processing. As a result thereof, strength of the steel wire rods was favorable, less than 1000 MPa. Only, when cooling speed was 7° C./second, even in the inventive example, it was checked that fraction of the low temperature structure was more than 1% and tensile strength of the steel wire rod was relatively high, more than 1000 MPa. The difference between the comparative examples and the inventive examples was caused by AGS before cooling. In the case of comparative examples, prior AGS that allows AGS at a room temperature to be checked was 12 μm or more. On the other hand, in the case of inventive examples, the prior AGS was 6 μm or less, different from the comparative examples.

Also, as known from Table 3, in the case of the inventive examples satisfying the composition according to the present invention, the tensile strength thereof was 2000 MPa or more, which was a satisfactory value. In the case of the comparative examples 1 to 4, the tensile strength thereof was notably unsatisfactory. These advantageous effects are caused by the steel composition according to the present invention. That is, in the steel composition defined according to the present invention, an amount of added Si is reduced to reduce an effect of surface decarbonization, and B, V, and Ti are compositely added to replace a loss of strength occurring due to the reduction of Si. The adding B, V, and Ti are due to reducing decreases of strength and toughness by a grain fining action performed by precipitates such as V(C, N) and Ti(C, N) in quenching and increased quenching properties and grain boundary strengthening action by B and improving strength due to precipitation strengthening caused in tempering.

The invention claimed is:

1. A steel wire rod for a high strength and high toughness spring having excellent cold workability, the steel wire rod having a composition comprising: in weight %, C: 0.4 to 0.7%, Si: 1.5 to 3.5%, Mn: 0.3 to 1.0%, Cr: 0.01 to 1.5%, Ni: 0.01 to 1.0%, Cu: 0.01 to 1.0%, B: 0.008 to 0.02%, Al: 0.02 to 0.1%, O: 0.0020% or less, P: 0.02% or less, S: 0.02% or less, N: 0.02% or less, remainder Fe, and other unavoidable impurities, having an internal structure formed of ferrite and pearlite, the internal structure in which prior austenite grain size is 8 μm or less, wherein the steel wire rod has a tensile strength less than 1000 MPa after hot rolling and peeling and shaving the hot rolled steel wire rod without annealing thereof, and wherein the unannealed steel wire rod has an unsoftened structure.

2. The steel wire rod of claim 1, wherein a sum of area fractions of bainite and martensite structures among the internal structure of the steel wire rod is less than 1%.

3. The steel wire rod of claim 1, wherein the composition of the steel wire rod further comprises: in weight %, V: 0.5% or less and Ti: 0.5% or less.

4. A method of manufacturing a spring by using a high strength and high toughness hot rolled steel wire rod having excellent cold workability, the steel wire rod having a composition comprising: in weight %, C: 0.4 to 0.7%, Si: 1.5 to 3.5%, Mn: 0.3 to 1.0%, Cr: 0.01 to 1.5%, N: 0.01 to 1.0%, Cu: 0.01 to 1.0%, B: 0.008 to 0.02%, Al: 0.02 to 0.1%, O: 0.0020% or less, P: 0.02% or less, S: 0.02% or less, N: 0.02% or less, remainder Fe, and other unavoidable impurities, having an internal structure formed of ferrite and pearlite, the internal structure in which prior austenite grain size is 8 μm or less, the method comprising:

peeling and shaving the hot rolled steel wire rod without annealing, wherein the hot rolled steel wire rod has a tensile strength of less than 1000 MPa after peeling and shaving the hot rolled steel wire rod without annealing thereof;

austeniting the peeled and shaved steel wire rod;

oil-cooling the austenited steel wire rod;

tempering the oil-cooled steel wire rod; and cold working the tempered steel wire rod in a spring shape.

5. A method of manufacturing a spring by using a high strength and high toughness hot rolled steel wire rod having excellent cold workability, the steel wire rod having a composition comprising: in weight %, C: 0.4 to 0.7%, Si: 1.5 to 3.5%, Mn: 0.3 to 1.0%, Cr: 0.01 to 1.5%, N: 0.01 to 1.0%, Cu: 0.01 to 1.0%, B: 0.008 to 0.02%, Al: 0.02 to 0.1%, O: 0.0020% or less, P: 0.02% or less, S: 0.02% or less, N: 0.02% or less, remainder Fe, and other unavoidable impurities, having an internal structure formed of ferrite and pearlite, the internal structure in which prior austenite grain size is 8 μm or less, the method comprising:

peeling and shaving the hot rolled steel wire rod without annealing, wherein the hot rolled steel wire rod has a tensile strength of less than 1000 MPa after peeling and shaving the hot rolled steel wire rod without annealing thereof;

hot working the peeled and shaved steel wire rod in a spring shape;

austeniting the hot worked spring;

oil-cooling the austenited spring; and tempering the oil-cooled spring.

6. The method of claim 4, wherein an austeniting temperature is 900 to 1000° C.

7. The method of claim 4, wherein a tempering temperature is 350 to 450° C.

8. The steel wire rod of claim 2, wherein the composition of the steel wire rod further comprises: in weight %, V: 0.5% or less and Ti: 0.5% or less.

9. The method of claim 5, wherein an austeniting temperature is 900 to 1000° C.

10. The method of claim 5, wherein a tempering temperature is 350 to 450° C.

* * * * *